US006338168B1

(12) United States Patent
Valentine

(10) Patent No.: US 6,338,168 B1
(45) Date of Patent: Jan. 15, 2002

(54) WEIGHT CORE DRAIN COVERING SYSTEM

(76) Inventor: Carolyn E. Valentine, P.O. Box 1656, Fletcher, NC (US) 28732

( * ) Notice: Subject to any disclaimer, the term of this patent is extended or adjusted under 35 U.S.C. 154(b) by 0 days.

(21) Appl. No.: 09/658,697

(22) Filed: Sep. 8, 2000

(51) Int. Cl.[7] ..... A47K 1/14
(52) U.S. Cl. ..... 4/293; 4/286; 4/583
(58) Field of Search ..... 4/286, 287, 293, 4/295, 581, 583, 657

(56) References Cited

U.S. PATENT DOCUMENTS 324,492 A * 8/1885 Schwab ..... 4/295
1,912,312 A * 5/1933 Schacht ..... 4/293
3,020,562 A * 2/1962 Reynolds ..... 4/581
3,788,485 A 1/1974 Bruning
3,800,339 A 4/1974 Bergin
D261,418 S 10/1981 Jackson
4,919,457 A 4/1990 Moretti
5,592,701 A 1/1997 Smith
5,832,544 A 11/1998 Pan

* cited by examiner

*Primary Examiner*—Gregory Huson
*Assistant Examiner*—Tuan Nguyen

(57) ABSTRACT

A drain covering system for preventing water from going down the drain. The drain covering system includes a basin that has a drain and a drain covering member that includes an outer covering and a weighted core. The drain covering member is positionable over the drain such that the outer perimeter of the drain covering member contacts a portion of the basin around the drain. The drain covering member is adapted for preventing a liquid from passing through the drain.

10 Claims, 2 Drawing Sheets

WEIGHT CORE DRAIN COVERING SYSTEM

BACKGROUND OF THE INVENTION

1. Field of the Invention

The present invention relates to sink stoppers and more particularly pertains to a new drain covering system for preventing water from going down the drain.

2. Description of the Prior Art

The use of sink stoppers is known in the prior art. More specifically, sink stoppers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,592,701; 5,832,544; 4,919,457; 3,800,339; U.S. Pat. No. Des. 261,418; and U.S. Pat. No. 3,788,485.

While these devices fulfill their respective, particular objectives and requirements, the aforementioned patents do not disclose a new drain covering system. The inventive device includes a basin that has a drain and a drain covering member that includes an outer covering and a weighted core. The drain covering member is positionable over the drain such that the outer perimeter of the drain covering member contacts a portion of the basin around the drain. The drain covering member is adapted for preventing a liquid from passing through the drain.

In these respects, the drain covering system according to the present invention substantially departs from the conventional concepts and designs of the prior art, and in so doing provides an apparatus primarily developed for the purpose of preventing water from going down the drain.

SUMMARY OF THE INVENTION

In view of the foregoing disadvantages inherent in the known types of sink stoppers now present in the prior art, the present invention provides a new drain covering system construction wherein the same can be utilized for preventing water from going down the drain.

The general purpose of the present invention, which will be described subsequently in greater detail, is to provide a new drain covering system apparatus and method which has many of the advantages of the sink stoppers mentioned heretofore and many novel features that result in a new drain covering system which is not anticipated, rendered obvious, suggested, or even implied by any of the prior art weighted sink stoppers, either alone or in any combination thereof.

To attain this, the present invention generally comprises a basin that has a drain and a drain covering member that includes an outer covering and a weighted core. The drain covering member is positionable over the drain such that the outer perimeter of the drain covering member contacts a portion of the basin around the drain. The drain covering member is designed for preventing a liquid from passing through the drain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new drain covering system apparatus and method which has many of the advantages of the sink stoppers mentioned heretofore and many novel features that result in a new drain covering system which is not anticipated, rendered obvious, suggested, or even implied by any of the prior art sink stoppers, either alone or in any combination thereof.

It is another object of the present invention to provide a new drain covering system which may be easily and efficiently manufactured and marketed.

It is a further object of the present invention to provide a new drain covering system which is of a durable and reliable construction.

An even further object of the present invention is to provide a new drain covering system which is susceptible of a low cost of manufacture with regard to both materials and labor, and which accordingly is then susceptible of low prices of sale to the consuming public, thereby making such drain covering system economically available to the buying public.

Still yet another object of the present invention is to provide a new drain covering system which provides in the apparatuses and methods of the prior art some of the advantages thereof, while simultaneously overcoming some of the disadvantages normally associated therewith.

Still another object of the present invention is to provide a new drain covering system for preventing water from going down the drain.

Yet another object of the present invention is to provide a new drain covering system which includes a basin that has a drain and a drain covering member that includes an outer covering and a weighted core. The drain covering member is positionable over the drain such that the outer perimeter of the drain covering member contacts a portion of the basin around the drain. The drain covering member is adapted for preventing a liquid from passing through the drain.

Still yet another object of the present invention is to provide a new drain covering system that prevents food from going down the drain.

Even still another object of the present invention is to provide a new drain covering system that prevents utensils from entering the drain These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
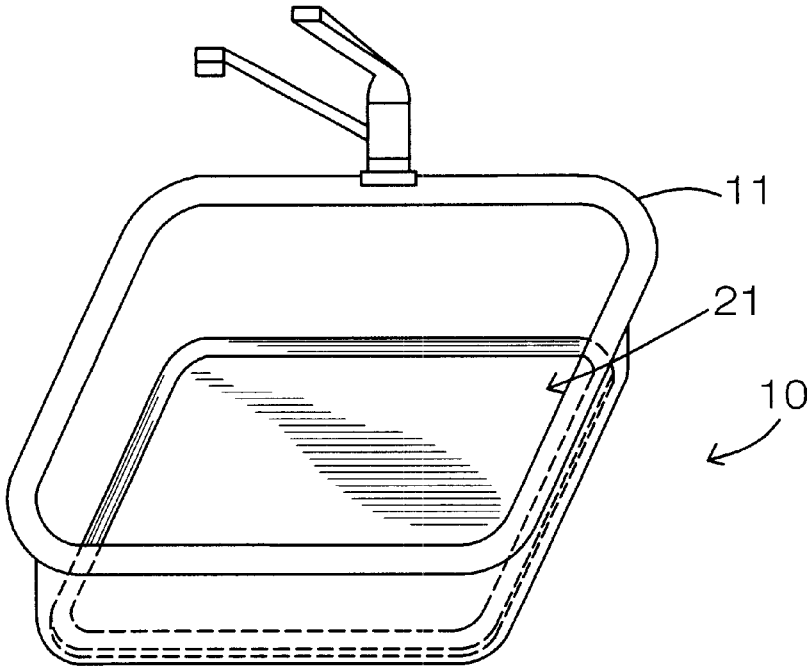
FIG. 1 is a perspective view of a new drain covering system according to the present invention.
Figure 2:
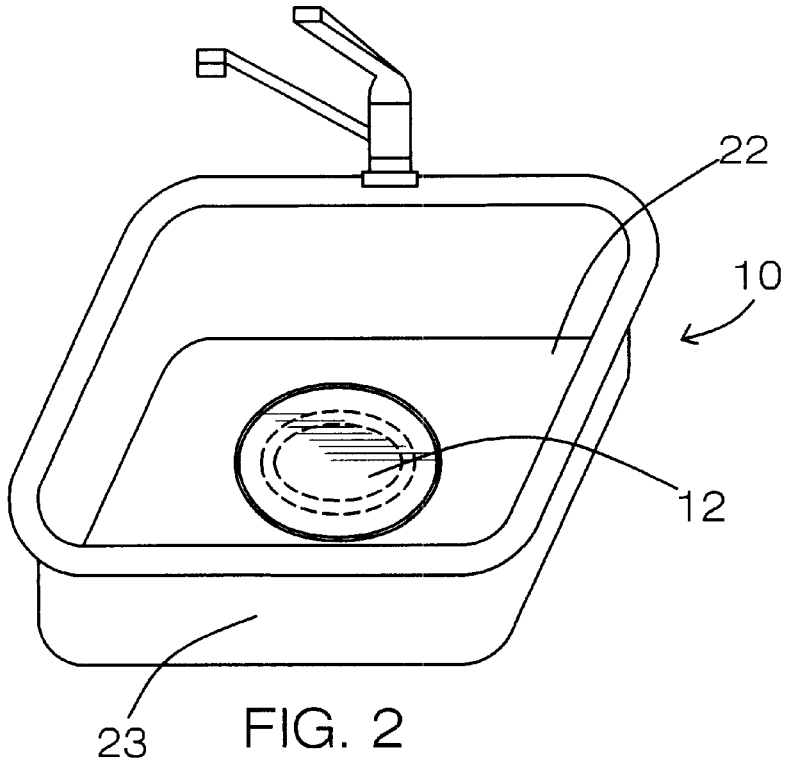
FIG. 2 is a perspective view of the present invention.
Figure 3:
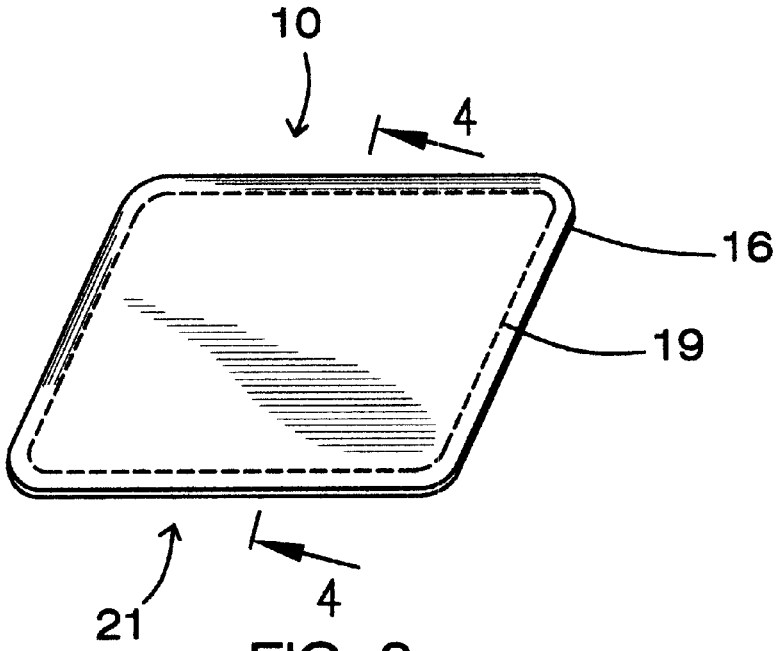
FIG. 3 is a perspective view of the present invention.
Figure 4:
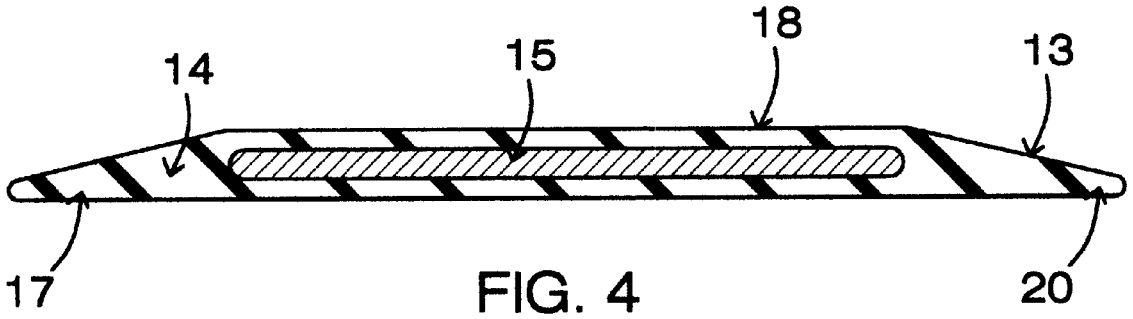
FIG. 4 is a cross section view of the present invention.

With reference now to the drawings, and in particular to FIGS. 1 through 4 thereof, a new drain covering system embodying the principles and concepts of the present invention and generally designated by the reference numeral 10 will be described.

As best illustrated in FIGS. 1 through 4, the drain covering system 10 generally comprises of a basin 11 that has a drain 12.

Also included is a drain covering member 21 that has an outer covering 14 and a weighted core 15.

The drain covering member 21 is positionable over the drain 12 such that an outer perimeter of the drain covering member 21 contacts a portion of the basin 11 around the drain 12. The drain covering member 21 is for preventing a liquid from passing through the drain 12.

The cover member 13 has an outer edge portion 16 extending outwardly from an outer perimeter edge of the core 15.

The cover member 13 has a planar bottom surface 17 and a planar central upper surface 18. The central upper surface 18 is positioned substantially parallel to the bottom surface 17.

The outer edge portion 16 of the cover member 13 tapering from an outer edge 19 of the central upper surface 18 to an outer edge 20 of the bottom surface 17. The outer edge portion 16 has a generally triangular cross-section taken parallel to a central axis of the cover member 13.

A cross-section of the cover member 13 taken perpendicular to the central axis of the cover member 13 has a shape chosen from the group of shapes consisting of circular and rectangular.

The outer covering 14 is constructed from rubber for forming a seal around the drain 12 when the cover member 13 is positioned over the drain 12 such that the outer perimeter of the drain covering member 21 contacts the portion of the basin 11 around the drain 12.

In an embodiment, the basin 11 has a bottom 22 and a perimeter wall 23 extending upwardly from a perimeter edge of the bottom 22. The cover member 13 has an outer perimeter edge . The outer perimeter edge generally conforming to the outer perimeter edge of the bottom 22 such that the cover member 13 fully covers an upper surface of the bottom 22.

In use, place the covering member over the sink drain, so that the bottom planar surface of the weighted core is on the upper surface of the sink drain.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain covering system comprising:

a basin having a drain;

a drain covering member having an outer covering and a weighted core;

said drain covering member being positionable over said drain such that an outer perimeter of said drain covering member contacts a portion of said basin around said drain whereby said drain covering member is adapted for preventing a liquid from passing through said drain; and said weighted core being positioned within said outer covering of said drain covering member such that said weighted core is not extending beyond a planar bottom surface of said drain covering member for facilitating placement of said drain covering member without needing to align a central axis of said drain covering member with a central axis of said drain when liquid is to be prevented from passing through said drain.

2. The drain covering system of claim 1, further comprising:

said basin having a bottom and a perimeter wall extending upwardly from a perimeter edge of said bottom;

said cover member having an outer perimeter edge, said outer perimeter edge generally conforming to said outer perimeter edge of said bottom such that said cover member fully covers an upper surface of said bottom.

3. The drain covering system of claim 1, further comprising:

said cover member having an outer edge portion extending outwardly from an outer perimeter edge of said core.

4. The drain covering system of claim 3, further comprising:

said cover member having a planar central upper surface, said central upper surface being positioned substantially parallel to said bottom surface.

5. The drain covering system of claim 4, further comprising:

said outer edge portion of said cover member tapering from an outer edge of said central upper surface to an outer edge of said bottom surface such that said outer edge portion has a generally triangular cross-section taken parallel to a central axis of said cover member.

6. The drain covering system of claim 1, further comprising:

said outer perimeter of said cover member being generally circular such that said outer perimeter has a diameter greater than a diameter of said drain of said basin.

7. The drain covering system of claim 1, further comprising:

said cover member having a generally rectangular cross-section taken perpendicular to a central axis of said cover member.

8. The drain covering system of claim 1, further comprising:

said outer covering comprising rubber, said rubber of said outer covering being for facilitating forming a seal around said drain when said cover member is positioned over said drain such that said outer perimeter of said drain covering member contacts said portion of said basin around said drain.

9. A drain covering system comprising:

a basin having a drain;

a drain covering member having an outer covering and a weighted core;

said drain covering member being positionable over said drain such that an outer perimeter of said drain covering member contacts a portion of said basin around said drain whereby said drain covering member is adapted for preventing a liquid from passing through said drain;

said weighted core being positioned within said outer covering of said drain covering member such that said weighted core is not extending beyond a planar bottom surface of said drain covering member for facilitating placement of said drain covering member without needing to align a central axis of said drain covering member with a central axis of said drain when liquid is to be prevented from passing through said drain;

said cover member having an outer edge portion extending outwardly from an outer perimeter edge of said core;

said cover member having a planar bottom surface and a planar central upper surface, said central upper surface being positioned substantially parallel to said bottom surface;

said outer edge portion of said cover member tapering from an outer edge of said central upper surface to an outer edge of said bottom surface such that said outer edge portion has a generally triangular cross-section taken parallel to a central axis of said cover member;

a cross-section of said cover member taken perpendicular to said central axis of said cover member having a shape chosen from the group of shapes consisting of circular and rectangular; and said outer covering being constructed from rubber for facilitating forming a seal around said drain when said cover member is positioned over said drain such that said outer perimeter of said drain covering member contacts said portion of said basin around said drain.

10. The drain covering system of claim 9, further comprising:

said basin having a bottom and a perimeter wall extending upwardly from a perimeter edge of said bottom; and said cover member having an outer perimeter edge, said outer perimeter edge generally conforming to said outer perimeter edge of said bottom such that said cover member fully covers an upper surface of said bottom.

* * * * *